US008240156B2

(12) United States Patent
Han et al.

(10) Patent No.: US 8,240,156 B2
(45) Date of Patent: Aug. 14, 2012

(54) ICE DISPENSING TECHNOLOGY

(75) Inventors: Seung Do Han, Seoul (KR); Ho Youn Lee, Seoul (KR); Young Jin Kim, Seoul (KR); Tae Hee Lee, Seoul (KR); Sung Yong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 509 days.

(21) Appl. No.: 12/488,628

(22) Filed: Jun. 22, 2009

(65) Prior Publication Data

US 2010/0122546 A1 May 20, 2010

(30) Foreign Application Priority Data

Nov. 14, 2008 (KR) ..... 10-2008-0113686

(51) Int. Cl.
*F25C 1/00* (2006.01)

(52) U.S. Cl. ..... 62/66; 62/344

(58) Field of Classification Search ..... 62/137, 62/340, 344, 380, 381, 389, 66, 126, 129; 222/23, 639, 505; 700/275
See application file for complete search history.

(56) References Cited

U.S. PATENT DOCUMENTS 4,787,539 A * 11/1988 Uchida et al. ..... 222/639
6,024,118 A * 2/2000 Ikari et al. ..... 137/375
7,017,364 B2 * 3/2006 Lee et al. ..... 62/351
2004/0237563 A1 * 12/2004 Lee et al. ..... 62/340
2004/0261427 A1 * 12/2004 Tsuchikawa et al. ..... 62/66
2005/0061016 A1 * 3/2005 Lee et al. ..... 62/340
2005/0072167 A1 * 4/2005 Oh ..... 62/137
2005/0241330 A1 11/2005 Son
2006/0117786 A1 * 6/2006 Lee et al. ..... 62/351
2006/0150642 A1 7/2006 Tsuchikawa et al.
2006/0179869 A1 * 8/2006 Lee et al. ..... 62/340
2007/0186576 A1 * 8/2007 Lee et al. ..... 62/353
2008/0053138 A1 * 3/2008 Ryu et al. ..... 62/344
2008/0209938 A1 * 9/2008 Lee et al. ..... 62/340
2008/0236188 A1 * 10/2008 Lee et al. ..... 62/344
2010/0204832 A1 8/2010 Choi et al.

FOREIGN PATENT DOCUMENTS

EP 1491832 A1 12/2004
WO WO 2008/030023 A1 3/2008

OTHER PUBLICATIONS

European Search Report dated May 4, 2011 for Application No. EP09008457, 6 pages.

* cited by examiner

*Primary Examiner* — Mohammad Ali
(74) *Attorney, Agent, or Firm* — Fish & Richardson P.C.

(57) ABSTRACT

An ice-making device that includes a duct through which ice is dispensed and a duct-covering part for opening and closing the duct. An ice conveying part conveys the ice dispensed through the duct. A driving speed of the ice conveying part increases for a previously set initial driving time when the dispensing of the ice starts, and the ice conveying part is driven at a previously set target speed when the initial driving time elapses.

20 Claims, 5 Drawing Sheets

ICE DISPENSING TECHNOLOGY

CROSS-REFERENCE TO RELATED APPLICATIONS

The present application claims priority under 35 U.S.C. 119 and 35 U.S.C. 365 to Korean Patent Application No. 10-2008-0113686 (filed on Nov. 14, 2008), which is hereby incorporated by reference in its entirety.

FIELD

The present disclosure relates to ice dispensing technology.

BACKGROUND

A refrigerator is a home appliance that can store foods in a freezing state or a refrigeration state. A refrigerator may include a dispenser that can dispense ice and/or water to an outside of the refrigerator. The refrigerator provided with the dispenser includes devices for making and dispensing the ice.

SUMMARY

In one aspect, an ice-making device includes a duct through which ice is dispensed, a duct-covering part configured to open and close the duct, and an ice conveying part configured to promote movement of ice through the duct. The ice-making device also includes a control part that is configured to increase a driving speed of the ice conveying part for an initial driving time when a signal to start dispensing of ice is received, and that is configured to drive the ice conveying part at a target speed when the initial driving time elapses.

Implementations may include one or more of the following features. For example, the control part may be configured to linearly increase the driving speed of the ice conveying part during the initial driving time. The control part may be configured to linearly increase the driving speed of the ice conveying part for the initial driving time to reach the target speed. The duct-covering part may be configured to open the duct to allow passage of ice through the duct when an input part receives an operation signal to start dispensing of ice.

In some implementations, the duct-covering part may be configured to, when dispensing of ice is finished, close the duct after operation of the ice conveying part stops and a set period of time has elapsed. In these implementations, the control part may be configured to measure a time from the operation of the ice conveying part being stopped, compare the measured time to the set period of time, and trigger closing of the duct when the comparison reveals that the set period of time has elapsed.

In another aspect, an ice-making device includes a duct through which ice is dispensed, a duct-covering part configured to open and close the duct, and an ice conveying part configured to promote movement of ice through the duct. The ice-making device also includes a control part configured to control the duct-covering part and the ice conveying part. The control part is configured to control the duct-covering part to open the duct in response to a signal to start dispensing of ice and is configured to, in response to the signal to start dispensing of ice, increase a driving speed of the ice conveying part and drive the ice conveying part at a target speed when the driving speed of the ice conveying part reaches the target speed.

Implementations may include one or more of the following features. For example, the control part may be configured to control the ice conveying part to linearly increase the driving speed of the ice conveying part until the driving speed of the ice conveying part reaches the target speed.

In some implementations, the control part may be configured to control the ice conveying part to increase the driving speed of the ice conveying part for an initial driving time. In these implementations, the control part may be configured to control the ice conveying part to linearly increase the driving speed of the ice conveying part for the initial driving time.

In some examples, the control part may be configured to, when dispensing of ice is finished, control the duct-covering part to close the duct after a set period of time has elapsed. In these examples, the control part may be configured to measure a time from an operation of the ice conveying part being stopped, compare the measured time to the set period of time, and trigger closing of the duct when the comparison reveals that the set period of time has elapsed.

The control part may be configured to, when dispensing of ice is finished, control the duct-covering part to close the duct after an operation of the ice conveying part stops.

In yet another aspect, a method of controlling an ice-making device includes controlling, using a control part, a duct-covering part to open a duct in response to a signal to start dispensing of ice. The method also includes, in response to the signal to start dispensing of ice, increasing, using the control part and during a first period of time after receiving the signal to start dispensing of ice, a driving speed of an ice conveying part, which is configured to promote movement of ice through the duct. The method further includes driving, using the control part and during a second period of time that is different than and immediately subsequent to the first period of time, the ice conveying part at a target speed.

Implementations may include one or more of the following features. For example, the first period of time may be a previously set initial driving time and increasing the driving speed may be continuously performed for the previously set initial driving time. Increasing the driving speed may be continuously performed until the driving speed of the ice conveying part reaches the target speed.

In some examples, the method may include stopping, using the control part, the ice conveying part when the dispensing of ice is completed and controlling, using the control part, the duct-covering part to close the duct when the ice conveying part is stopped. In these examples, the method may include receiving, using an input part, an operation signal to start the dispensing of ice, and determining that the dispensing of ice is completed based on at least one of receiving, using the input part, an operation signal for finishing the dispensing of ice, determining that the input to start the dispensing of ice received using the input part has ended, and determining that an ice dispensing time set based on the input to start the dispensing of ice received using the input part has ended.

In some implementations, the method may include controlling, using the control part, the duct-covering part to close the duct when a set period of time has elapsed after the stopping of the ice conveying part. In these implementations, the method may include measuring, using the control part, a time from the operation of the ice conveying part being stopped, comparing, using the control part, the measured time to the set period of time, and triggering, using the control part, closing of the duct when the comparison reveals that the set period of time has elapsed.

The details of one or more implementations are set forth in the accompanying drawings and the description below. Other features will be apparent from the description and drawings, and from the claims.

DETAILED DESCRIPTION

Figure 1:
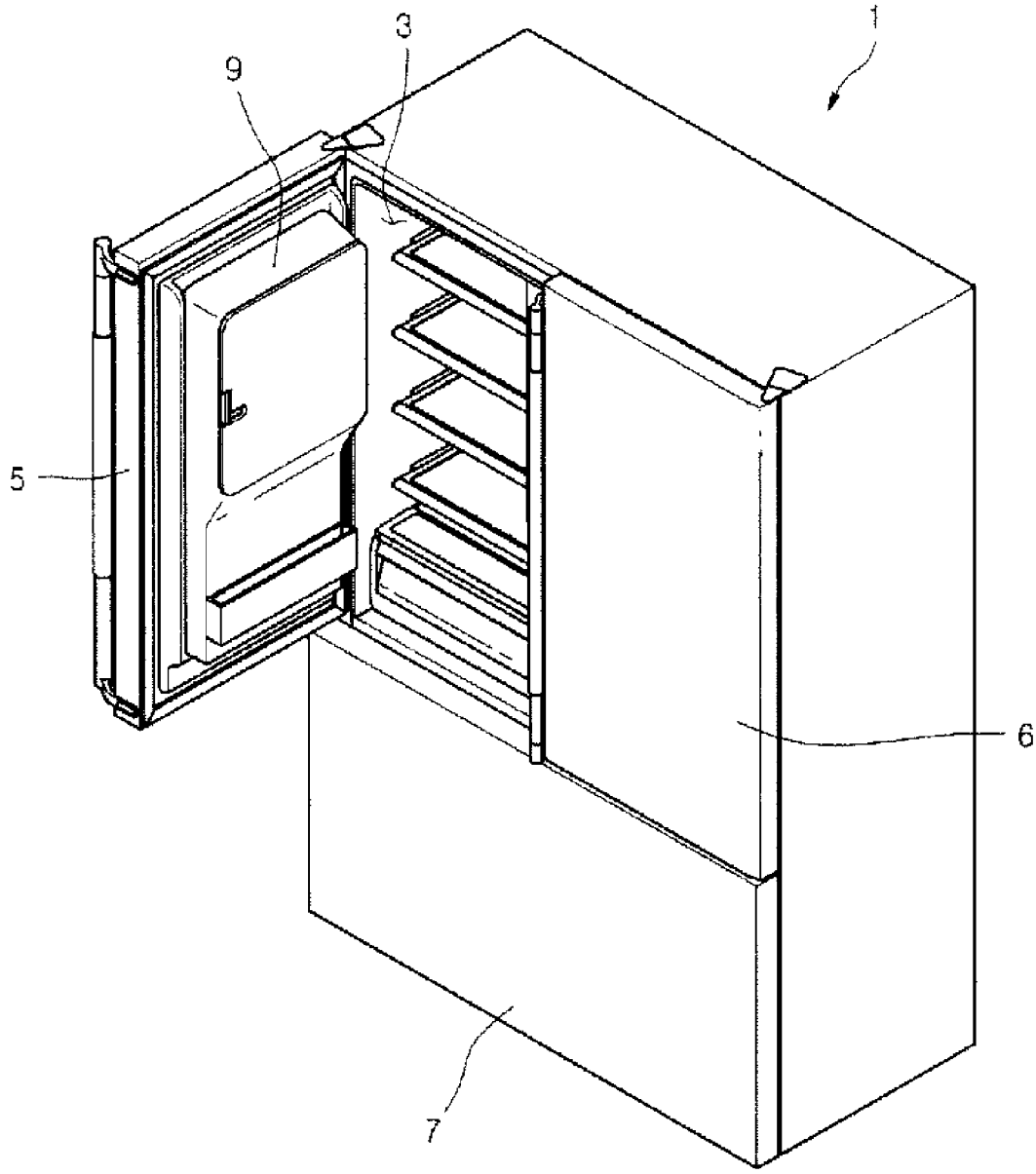
FIG. 1 is a perspective view of a refrigerator with an ice-making device.
Figure 2:
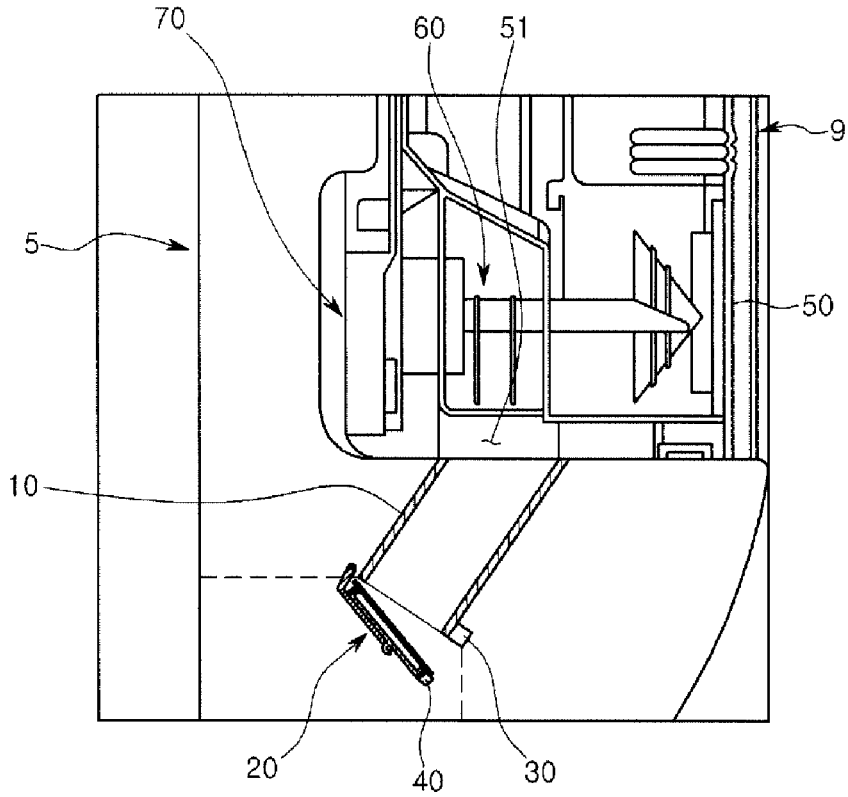
FIG. 2 is a cross-sectional view of a part of an ice-making device.
Figure 3:
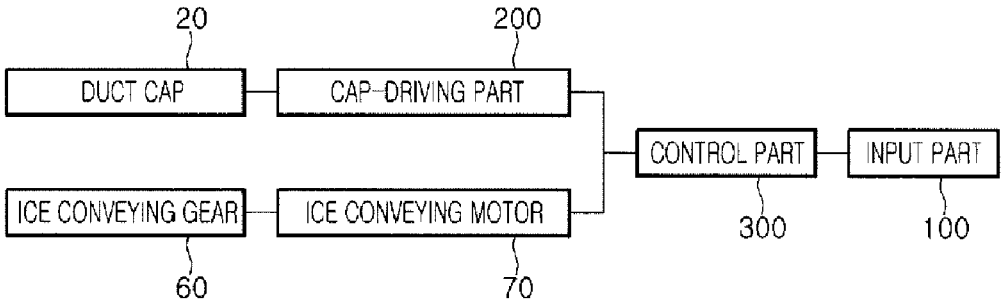
FIG. 3 is a schematic view of a configuration of an ice dispensing control system.
Figure 4:
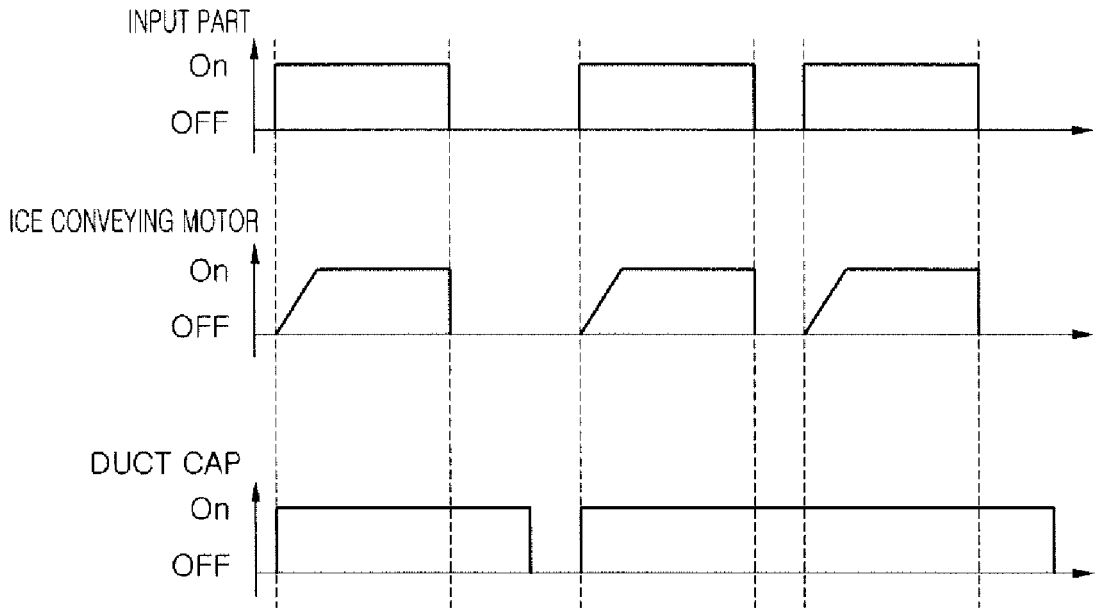
FIG. 4 is a graph illustrating operations of a duct cap and an ice conveying motor when dispensing of ice starts.

FIG. 1 illustrates an example of a refrigerator with an ice-making device, and FIG. 2 illustrates a cross-section of an example of a part of an ice-making device. FIG. 3 illustrates an example configuration of an ice dispensing control system, and FIG. 4 illustrates operations of a duct cap and an ice conveying motor when dispensing of ice starts.

Referring to FIG. 1, a refrigerator compartment 3 and a freezer compartment are disposed in a main body 1. The refrigerator compartment 3 and the freezer compartment, where foods are stored, are arranged vertically in the main body 1, with the refrigerator compartment 3 being positioned above the freezer compartment. The refrigerator compartment 3 is opened and closed by refrigerator compartment doors 5 and 6 and the freezer compartment is opened and closed by a freezer compartment door 7.

An ice-making chamber 9 is provided to an inner surface of the refrigerator compartment door 5 (hereinafter, referred to as a "door"). The ice-making chamber 9 is separated from the refrigerator compartment 3. An ice-making device including an ice maker (not shown) for making ice and an ice bin 50 for storing the ice made in the ice maker is disposed inside the ice-making chamber 9.

A dispenser (not shown) is provided on a front surface of the door 5. The dispenser is used to dispense water and/or ice without opening the door 5.

Referring to FIG. 2, an ice duct 10 is disposed inside the door 5. The ice duct 10 is used to dispense the ice stored in the ice bin 50 to the outside of the refrigerator, that is, to the outside of the refrigerator through the dispenser which transports ice through the door 5 when the door 5 is in a closed positioned. For this, a first end of the ice duct 10 communicates with the ice bin and a second end of the ice duct 10 communicates with the dispenser.

A duct cap 20 opens and closes an end of the ice duct 10 adjacent to the dispenser (e.g., the second end of the ice duct 10 that communicates with the dispenser). One end of the duct cap 20 rotates about the other end to open and close the ice duct 10.

A hall sensor 30 and a magnet 40 are disposed on the ice duct 10 and the duct cap 20, respectively. In the state where the duct cap 20 closes the ice duct 10, the hall sensor 30 and the magnet 40 may be disposed at positions at which the ice duct 10 faces the duct cap 20. The hall sensor 30 and the magnet 40 sense a position of the duct cap 20 with respect to the ice duct 10. In detail, the hall sensor 30 disposed on the ice duct 10 senses strength (e.g., presence or absence) of a magnetic field of the magnet 40 disposed on the duct cap 20 to sense the position of the duct cap 20 with respect to the ice duct 10. When the duct cap 20 closes the ice duct 10, the hall sensor 30 senses a relatively strong (e.g., a present) magnetic field and detects that the duct cap 20 is in a position to close the ice duct 10. When the duct cap 20 opens the ice duct 10, the hall sensor 30 senses a relatively weak (e.g., an absent) magnetic field and detects that the duct cap 20 is in a position to open the ice duct 10.

An ice dispensing opening 51 is defined in a bottom surface of the ice bin 50 disposed inside the ice-making chamber 9. The ice dispensing opening 51 serves as an outlet port through which the ice stored in the ice bin 50 is dispensed to the outside of the ice bin 50. For this, the ice dispensing opening 51 communicates with one end portion of the ice duct 10 (e.g., the first end of the ice duct 10 that communicates with the ice bin 50).

An ice conveying gear 60 is disposed inside the ice bin 50 adjacent to the ice dispensing opening 51. The ice conveying gear 60 conveys the ice stored in the ice bin 50 to dispense the ice through the ice dispensing opening 51.

An ice conveying motor 70 is disposed on a side of the ice-making chamber 9. The ice conveying motor 70 provides a driving force for operating the ice conveying gear 60. The ice conveying motor 70 may be coupled to the ice conveying gear 60 in a state where the ice bin 50 is disposed inside the ice-making chamber 9. Alternatively, the ice conveying motor 70 may be disposed on a side of the ice bin 50.

Referring to FIG. 3, an input part 100 receives an operation signal for dispensing the ice through the dispenser. A dispensing lever may be used as the input part 100. The dispensing lever may be disposed on a side of the dispenser and pressed by a container for receiving the ice by a user. Thus, when the input part 100 is pressed by the container, an operation signal for dispensing the ice through the dispenser is received. When the input part 100 is not pressed by the container any longer, an operation signal for finishing the dispensing of the ice through the dispenser is received. Other types of dispensing buttons or input controls may be used as the input part 100.

A cap-driving part 200 provides a driving force for rotating the duct cap 20. For example, the cap-driving part 200 may include a solenoid valve or a motor. That is, the cap-driving part 200 rotates in a predetermined direction or a reverse direction to allow the duct cap 20 to open or close one end of the ice duct 10.

A control part 300 (e.g., an electronic controller, a processor, etc.) controls the dispensing of the ice through the dispenser. For instance, the control part 300 controls the cap-driving part 200 according to the operation signals inputted to the input part 100 to rotate the duct cap 20, and thereby, to close or open the ice duct 10. The control part 300 controls operation of the ice conveying motor 70 according to the operation signal inputted into the input part 100. For example, the control part 300 controls the ice conveying motor 70 to rotate the ice conveying gear 60 to convey ice when a dispensing signal is received and stops the ice conveying motor 70 to stop the operation of the ice conveying gear 60 when a dispensing signal is not received or an end dispensing signal is received.

Referring to FIG. 4, the control part 300 controls the cap-driving part 200 to allow the duct cap 20 to open the ice duct 10 when the input part 100 receives the operation signal for dispensing the ice through the dispenser. The control part 300 controls the cap-driving part 200 to allow the duct cap 20 to close the ice duct 10 when the input 100 receives the operation signal for finishing the dispensing of the ice through the dispenser. At this time, the control part 300 controls the cap-driving part 200 to allow the duct cap 20 to close the ice duct 10 after the input part 100 receives the operation signal for finishing the dispensing of the ice through the dispenser, and a set period of time has elapsed after the input part 100 receives the operation signal for finishing the dispensing of the ice through the dispenser. This may be done to enable closing of the ice duct 10 only after the ice positioned in the ice duct 10 is completely dispensed even if the input part 100 receives the operation signal for finishing the dispensing of the ice through the dispenser when ice remains in the ice duct 10.

When the input part 100 receives the operation signal for dispensing ice through the dispenser, the control part 300 controls the ice conveying motor 70 to operate at a previously set target speed. In some implementations, the control part 300 increases a driving speed of the ice conveying motor 70, which operates the ice conveying gear 60, for the previously set time after which the ice conveying motor 70 operates at the previously set target speed In other implementations, the control part 300 controls the ice conveying motor 70 to operate at the target speed by increasing the driving speed of the ice conveying motor 70 the driving speed reaches the target speed. The target speed may be defined as a speed previously set according to the operation signals inputted into the input part 100. For example, the previously set time may be set to a time reaching the target speed by increasing the driving speed of the ice conveying motor 70.

In some examples, the control part 300 controls the driving speed of the ice conveying motor 70 to linearly increase for the previously set time. The control part 300 controls the ice conveying motor 70 to stop the operation of the ice conveying motor 70 when the input part 100 receives the operation signal for finishing the dispensing of the ice through the dispenser.

Figure 5:
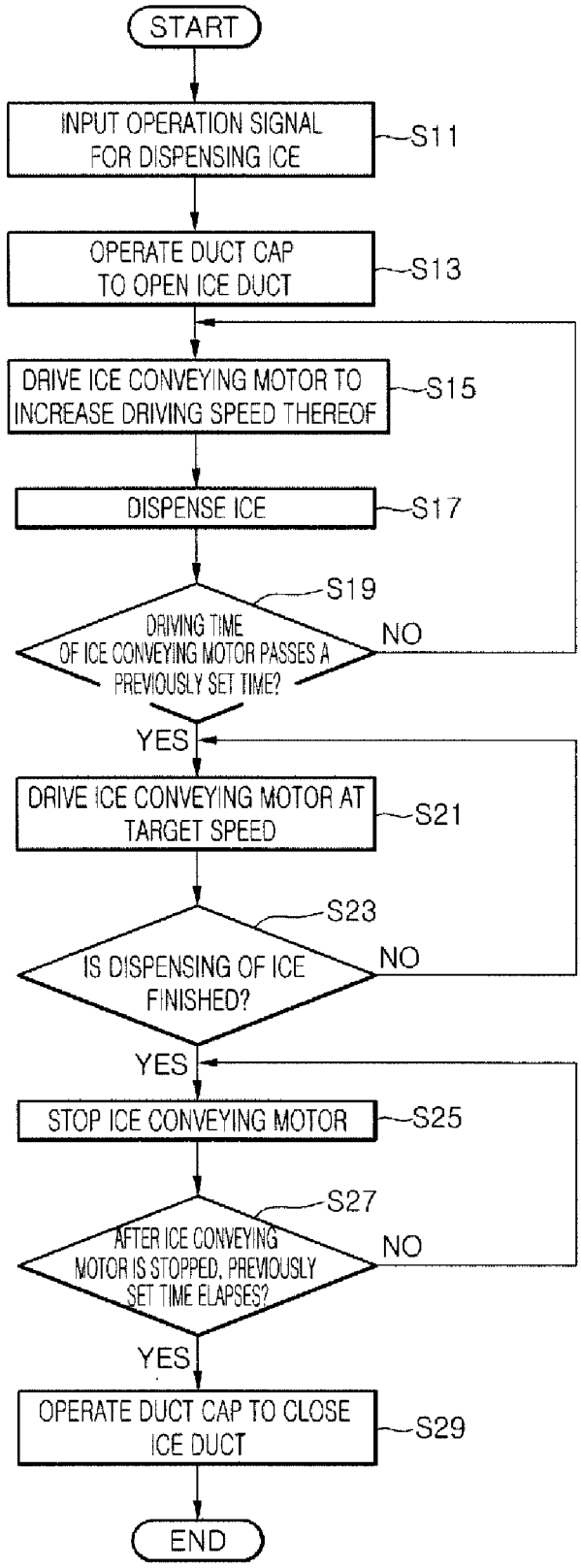
FIG. 5 is a flowchart illustrating a method of controlling an ice-making device.

FIG. 5 illustrates an example of a method of controlling an ice-making device.

Referring to FIG. 5, an input part 100 receives an operation signal for starting dispensing of ice through a dispenser (S11). The input part 100 may receive the operation signal for starting the dispensing of the ice through the dispenser by receiving a user's press of an operation button (not shown) or receiving a user's press of a lever (not shown) with a container for receiving ice.

When the input part 100 receives the operation signal for dispensing the ice (S11), a control part 300 controls an operation of a cap-driving part 200 to allow a duct cap 20 to open an ice duct 10 (S13). The control part 300 controls an ice conveying motor 70 to increase a driving speed of the ice conveying motor 70 (S15).

When the ice conveying motor 70 is driven (S15), the ice is dispensed (S17). In detail, the ice stored in an ice bin 50 is dispensed by an ice conveying gear 60 operated by driving the ice conveying motor 70 through the ice duct 10 opened by the duct cap 20. As described above, because the driving speed of the ice conveying motor 70 increases (S15), it may reduce the possibility of the ice conveying motor 70 being overloaded as a result of ice being positioned between the ice conveying gear 60 and the ice duct 10 or the ice bin 50 during an initial time period at which the ice is conveyed by the ice conveying gear 60.

The control part 300 determines whether a driving time of the ice conveying motor 70 has passed a previously set time (S19). When the driving time of the ice conveying motor 70 passes the previously set time (S19), the control part 300 controls the ice conveying motor 70 to drive the ice conveying motor 70 at a previously set target speed (S21). Thus, a further amount of ice can be dispensed through the ice duct 10.

The control part 300 determines whether the dispensing of the ice through the ice duct 10 is finished (S23). For example, whether the dispensing of the ice through the ice duct 10 is finished (S23) may be determined according to whether the input part 100 receives an operation signal for finishing the dispensing of the ice, according to whether the input part 100 further receives the operation signal for dispensing the ice (e.g., whether a user continues to supply a constant pressing force to a dispensing control button or lever), or according to whether an ice dispensing time set according to the operation signal for dispensing the ice and inputted to the input part 100 is finished.

When the dispensing of the ice through the ice duct 10 is finished (S23), the control part 300 controls the ice conveying motor 70 to stop an operation of the ice conveying motor 70 (S25). When the operation of the ice conveying motor 70 stops (S25), the control part 300 determines whether a previously set time elapses after the operation of the ice conveying motor 70 stops (S27). The previously set time may be the same previously set time used in driving the ice conveying motor 70 (S19) or may be a different previously set time.

When the previously set time elapses after the operation of the ice conveying motor 70 stops (S27), the control part 300 controls the cap-driving part 200 to allow the duct cap 20 to close the ice duct 10 (S29). Thus, since the ice duct 10 maintains in open state for the previously set time even if the ice conveying motor stops, the ice duct 10 is closed after the ice stored in the ice duct 10 is completely dispensed to the outside.

Figure 6:
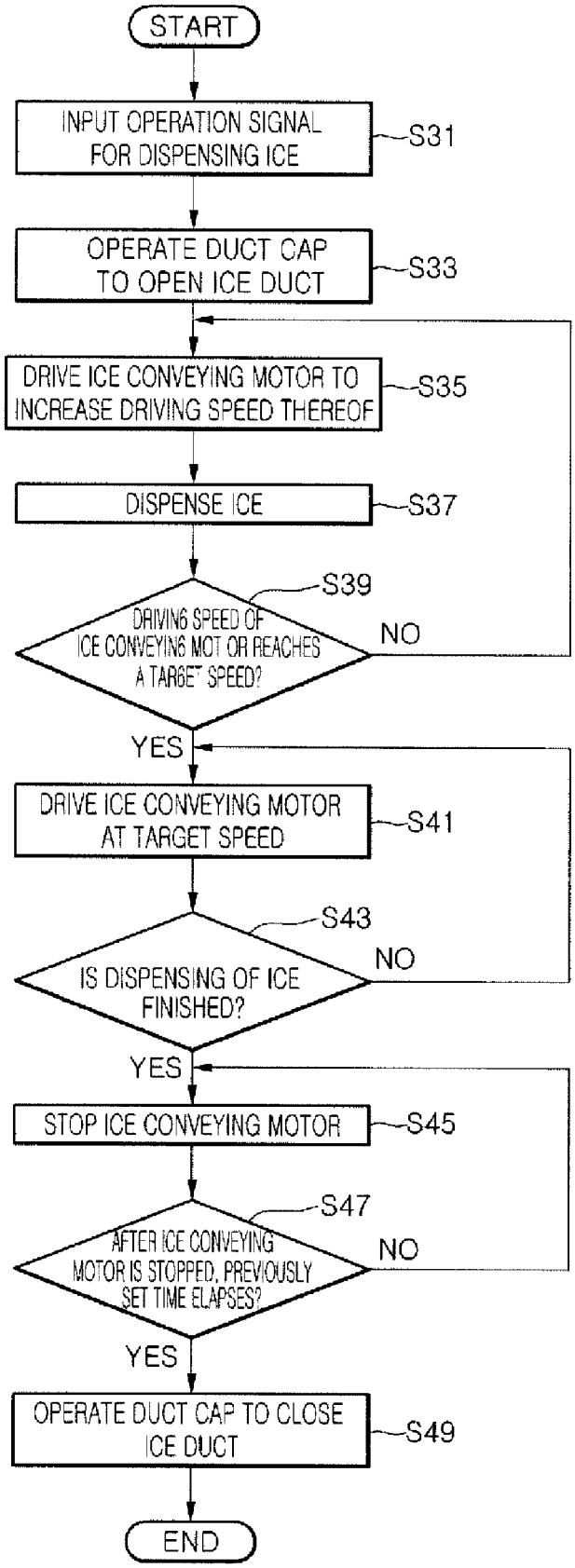
FIG. 6 is a flowchart illustrating a method of controlling an ice-making device.

FIG. 6 illustrates an example of a method of controlling an ice-making device.

Referring to FIG. 6, an input part receives an operation signal to start dispensing of ice (S31). A control part 300 controls an operation of a cap-driving part 200 to allow a duct cap 20 to open an ice duct 10 (S33). The control part 300 controls the ice conveying motor 70 to increase a driving speed of the ice conveying motor 70 (S35). Thus, the ice conveyed by an ice conveying gear 60 is dispensed through the ice duct 10 (S37).

The control part 300 determines whether the driving speed of the ice conveying motor 70 reaches a previously set target speed (S39). When the driving speed of the ice conveying motor 70 reaches the previously set target speed (S39), the control part 300 controls the ice conveying motor 70 to drive the ice conveying motor 70 at the target speed (S41).

The control part 300 determines whether the dispensing of the ice through the ice duct 10 is finished (S43). When the dispensing of the ice is finished, the control part 300 controls the ice conveying motor 70 to stop an operation of the ice conveying motor 70 (S45). When the dispensing of the ice is finished (S43), and the operation of the ice conveying motor 70 stops (S45), the control part 300 determines whether a previously set time elapses after the operation of the ice conveying motor 70 stops (S47). The control part 300 controls the cap-driving part 200 to allow the duct cap 20 to close the ice duct 10 (S49).

Although the ice-making device has been described as being installed in the ice-making chamber disposed on a back surface of the refrigerator compartment door, the present disclosure is not limited thereto. For example, the ice-making device may be installed in an ice-making chamber located inside of the refrigerator compartment door (e.g., within a storage space defined by the refrigerator compartment and separate from the door). Also, the ice-making device may be installed on a back surface of a freezer compartment door or located inside of the freezer compartment door (e.g., within a storage space defined by the freezer compartment and separate from the door).

Although the duct cap has been described as rotating to open or close the ice duct, the duct cap 20 is not limited to a rotating operation to open or close the ice duct. For example, the duct cap may be translated (e.g., slid) to open or close the ice duct.

The ice duct is a member for dispensing the ice, and the duct cap is a member for opening or closing the member for dispensing the ice. Thus, if the above-described functions can be performed, members and/or devices under any names may be substantially denoted as the same configuration as the ice duct and the duct cap.

Although the ice conveying gear and the ice conveying motor for conveying the ice stored in the ice bin are used in the above implementations, the present disclosure is not limited thereto. Also, although the ice made in the ice maker is stored in the ice bin in the above implementations, the present disclosure is not limited thereto. For example, the ice made in the ice maker may be stored in a member having a different name, e.g., an ice bank.

In some implementations, the driving speed of the ice conveying motor increases for a previously set time until the driving speed of the ice conveying motor reaches a previously set target speed after the ice duct is opened. Thus, in these implementations, gradually increasing the driving speed of the ice conveying motor to the target speed may reduce the likelihood of the ice conveying motor being overloaded as a result of ice being positioned between the ice conveying gear and the ice duct or the ice bin during the initial dispensing of the ice. Therefore, the potential for damage of the ice conveying motor may be reduced.

Also, in some implementations, since the driving speed of the ice conveying motor increases for the previously set time until the driving speed of the ice conveying motor reaches the previously set target speed, the dispensing speed of the ice substantially and gradually increases. Therefore, noise and breakage and/or blockage of the ice generated during the initial dispensing of the ice may be reduced.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice-making device comprising:

a duct through which ice is dispensed;

a duct-covering part configured to open and close the duct;

an ice conveying part configured to promote movement of ice through the duct; and a control part that is configured to increase a driving speed of the ice conveying part for an initial driving time when a signal to start dispensing of ice is received, and that is configured to drive the ice conveying part at a target speed when the initial driving time elapses.

2. The ice-making device according to claim 1, wherein the control part is configured to linearly increase the driving speed of the ice conveying part during the initial driving time.

3. The ice-making device according to claim 1, wherein the control part is configured to linearly increase the driving speed of the ice conveying part for the initial driving time to reach the target speed.

4. The ice-making device according to claim 1, wherein the duct-covering part is configured to open the duct to allow passage of ice through the duct when an input part receives an operation signal to start dispensing of ice.

5. The ice-making device according to claim 1, wherein the duct-covering part is configured to, when dispensing of ice is finished, close the duct after operation of the ice conveying part stops and a set period of time has elapsed.

6. The ice-making device according to claim 5, wherein the control part is configured to measure a time from the operation of the ice conveying part being stopped, compare the measured time to the set period of time, and trigger closing of the duct when the comparison reveals that the set period of time has elapsed.

7. An ice-making device comprising:

a duct through which ice is dispensed;

a duct-covering part configured to open and close the duct;

an ice conveying part configured to promote movement of ice through the duct; and a control part configured to control the duct-covering part and the ice conveying part, the control part being configured to control the duct-covering part to open the duct in response to a signal to start dispensing of ice and being configured to, in response to the signal to start dispensing of ice, increase a driving speed of the ice conveying part and drive the ice conveying part at a target speed when the driving speed of the ice conveying part reaches the target speed.

8. The ice-making device according to claim 7, wherein the control part is configured to control the ice conveying part to linearly increase the driving speed of the ice conveying part until the driving speed of the ice conveying part reaches the target speed.

9. The ice-making device according to claim 7, wherein the control part is configured to control the ice conveying part to increase the driving speed of the ice conveying part for an initial driving time.

10. The ice-making device according to claim 9, wherein the control part is configured to control the ice conveying part to linearly increase the driving speed of the ice conveying part for the initial driving time.

11. The ice-making device according to claim 7, wherein the control part is configured to, when dispensing of ice is finished, control the duct-covering part to close the duct after a set period of time has elapsed.

12. The ice-making device according to claim 11, wherein the control part is configured to measure a time from an operation of the ice conveying part being stopped, compare the measured time to the set period of time, and trigger closing of the duct when the comparison reveals that the set period of time has elapsed.

13. The ice-making device according to claim 7, wherein the control part is configured to, when dispensing of ice is finished, control the duct-covering part to close the duct after an operation of the ice conveying part stops.

14. A method of controlling an ice-making device, the method comprising:

controlling, using a control part, a duct-covering part to open a duct in response to a signal to start dispensing of ice;

in response to the signal to start dispensing of ice, increasing, using the control part and during a first period of time after receiving the signal to start dispensing of ice, a driving speed of an ice conveying part, which is configured to promote movement of ice through the duct; and driving, using the control part and during a second period of time that is different than and immediately subsequent to the first period of time, the ice conveying part at a target speed.

15. The method according to claim 14, wherein the first period of time is a previously set initial driving time and increasing the driving speed is continuously performed for the previously set initial driving time.

16. The method according to claim 14, wherein increasing the driving speed is continuously performed until the driving speed of the ice conveying part reaches the target speed.

17. The method according to claim 14, further comprising:

stopping, using the control part, the ice conveying part when the dispensing of ice is completed; and controlling, using the control part, the duct-covering part to close the duct when the ice conveying part is stopped.

18. The method according to claim 17, wherein:

controlling, using the control part, the duct-covering part to open the duct in response to the signal to start dispensing of ice comprises receiving, using an input part, an operation signal to start the dispensing of ice, and stopping, using the control part, the ice conveying part when the dispensing of ice is completed comprises determining that the dispensing of ice is completed based on at least one of receiving, using the input part, an operation signal for finishing the dispensing of ice, determining that the input to start the dispensing of ice received using the input part has ended, and determining that an ice dispensing time set based on the input to start the dispensing of ice received using the input part has ended.

19. The method according to claim 17, further comprising controlling, using the control part, the duct-covering part to close the duct when a set period of time has elapsed after the stopping of the ice conveying part.

20. The method according to claim 19, wherein controlling, using the control part, the duct-covering part to close the duct when a set period of time has elapsed after the stopping of the ice conveying part comprises measuring, using the control part, a time from the operation of the ice conveying part being stopped, comparing, using the control part, the measured time to the set period of time, and triggering, using the control part, closing of the duct when the comparison reveals that the set period of time has elapsed.

* * * * *